United States Patent [19]

Henriques

[11] 4,026,264

[45] May 31, 1977

[54] PORTABLE FIREPLACE HEATING UNIT

[76] Inventor: Joseph Henriques, 32 Hidden Brook Drive, Brookfield, Conn. 06804

[22] Filed: Dec. 9, 1974

[21] Appl. No.: 530,981

Related U.S. Application Data

[63] Continuation-in-part of Ser. No. 468,024, May 8, 1974, abandoned.

[52] U.S. Cl. ..... 126/123; 126/120; 126/121; 126/126

[51] Int. Cl.[2] ..... F24B 7/02

[58] Field of Search ..... 126/125, 126, 121, 120, 126/123, 288, 315, 140; 248/354 C, 354 P

[56] References Cited

UNITED STATES PATENTS

| | | | |
|---|---|---|---|
| 367,876 | 8/1887 | Wellington | 126/126 |
| 1,059,034 | 4/1913 | Clawson | 126/123 |
| 1,255,493 | 2/1918 | Williams | 126/123 |
| 1,433,520 | 10/1922 | Aizpuru | 126/123 |
| 1,546,503 | 7/1925 | Meier | 126/126 |
| 1,651,261 | 11/1927 | Farley | 126/315 |
| 2,743,720 | 5/1956 | Dollinger | 126/121 |

FOREIGN PATENTS OR APPLICATIONS

| | | | |
|---|---|---|---|
| 867,758 | 11/1941 | France | 126/126 |
| 267,542 | 9/1929 | Italy | 248/354 C |
| 26,748 | 11/1910 | United Kingdom | 126/120 |
| 655,381 | 7/1951 | United Kingdom | 126/121 |

*Primary Examiner*—William F. O'Dea

*Assistant Examiner*—Harold Joyce

*Attorney, Agent, or Firm*—Mattern, Ware, Davis & Stoltz

[57] ABSTRACT

A portable heating unit which may quickly and easily be installed in an existing fireplace construction is described. The heating unit, with a controlled adaptable damper system, greatly increases the burning efficiency of the fuel and is designed to provide a circulating warm air stream for heating a room. The heating unit can quickly and easily be moved from the fireplace opening to restore the fireplace to its original operation when the extra heat is no longer needed.

The portable heating unit may also be installed in a self-contained enclosure. This enclosure incorporates a triangular-shaped flue that interconnects with a nearby chimney. The triangular flue is constructed so as to connect with a chimney to the right or to the left of the heating unit enclosure thereby allowing one chimney to service more than one heating unit at the same floor level.

Furthermore, a radiator may be installed within the portable heating unit and interconnected to the hot water heating system of a home so as to provide alternate heating of the hot water system when the home furnace is inoperable.

The heating unit may also be converted to an outdoor barbecue when used without a self-contained enclosure.

10 Claims, 29 Drawing Figures

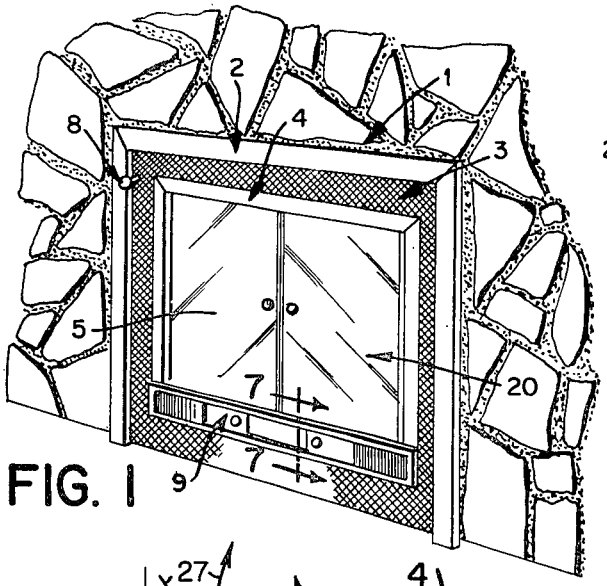
FIG. 1
FIG. 3
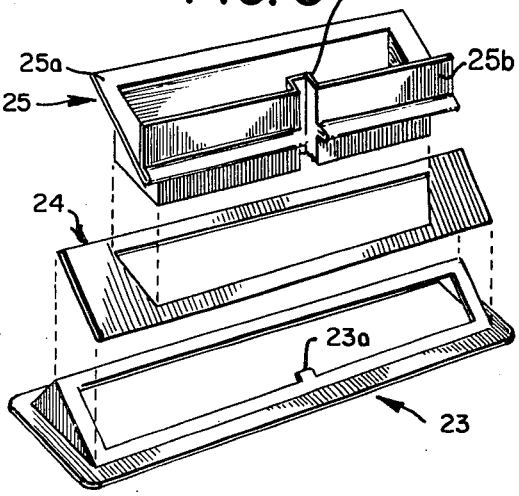
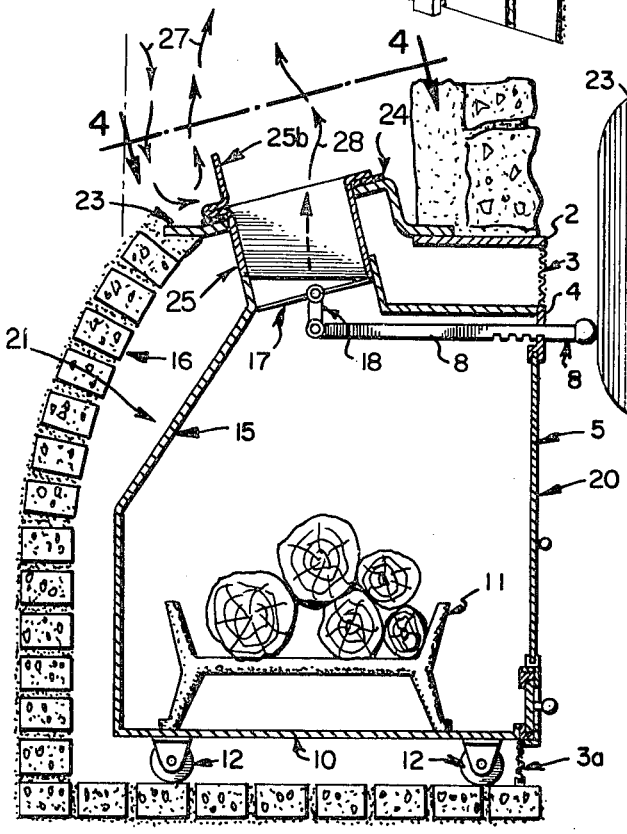
FIG. 2
FIG. 4
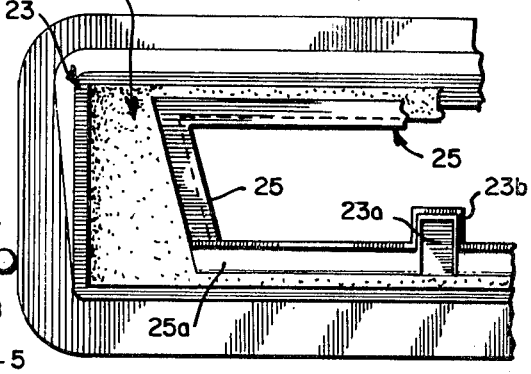
FIG. 5
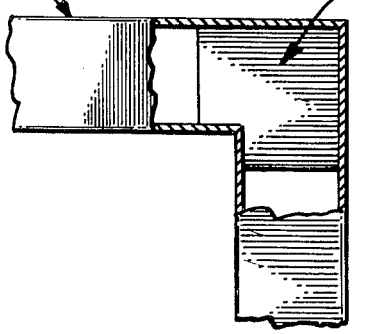

PORTABLE FIREPLACE HEATING UNIT

RELATED APPLICATIONS

This application is a continuation-in-part application of my co-pending U.S. Pat. Application bearing Ser. No. 468,024, filed May 8, 1974, now abondoned.

BACKGROUND OF THE INVENTION

This invention relates to a portable fireplace heating unit. More particularly this invention discloses an enclosed wood-burning fire-box which is easily installed in an existing fireplace opening. Further, the heating unit which greatly increases the heating efficiency of a standard fireplace, has a damper system which cooperates with the existing fireplace damper and flue system.

The recent shortages of fuel for heating homes have created the need not only to conserve resources but also to make better use of existing fuel resources in addition to finding and exploiting new sources of energy.

One of the oldest forms of heat energy, firewood, has in recent times been put aside for more convenient fuels such as gas and oil. However, with the ever increasing shortages of the more traditional fossil fuels, and with the knowledge that wood suitable for burning to provide heat is in plentiful supply in many areas, it is very advantageous to provide systems that would fit into existing fireplace constructions that would increase the heating efficiency of burning wood, coal or similar fuel.

Conventional fireplaces create strong drafts which draw heat from the room right up the chimney. This condition actually lowers the temperature in the other areas of the house away from the vicinity of the fire, and sometimes causes automatic thermostats to activate conventional heating systems to counteract this cooling effect.

The prior art has provided for supplemental heating units to be installed in existing fireplace systems. For example see Goulding U.S. Pat. No. 2,791,213; Craig U.S. Pat. No. 2,258,882; Barber U.S. Pat. No. 2,497,486; Morgan U.S. Pat. No. 2,196,934; Baruck et al U.S. Pat. No. 2,046,051 and Forbes U.S. Pat. No. 1,309,024; Meier U.S. Pat. No. 1,546,503; Newton U.S. Pat. No. 2,172,711; Holz U.S. Pat. No. 2,120,977; Baruch et al U.S. Pat. No. 2,048,675; Johnston U.S. Pat. No. 1,336,700; Robinson U.S. Pat. No. 551,651; Lewis U.S. Pat. No. 463,061; and Jackson U.S. Pat. No. 394,653; but none offers the combination of conveniences that I have provided in my fireplace heating unit.

It is thus the main object of this invention to provide a portable fireplace heating unit wherein an adaptable damper system allows the unit to be quickly and easily installed in an existing fireplace, and when not needed the unit may be easily removed and rolled to a storage area. This heating unit further causes air from the room to circulate around the firebox but not up the chimney. This heated air is then re-directed into the room area, providing a source of heat. Due to the geometry of the heating unit, this circulation of air under and around the firebox is greatly enhanced so that free convection of air is maximized. Thus, although Johnson and Meier teach fireplace enclosures incorporating air vent holes around the side and top of their stoves, none of these patents teach the very important aspect of having vent holes beneath a firebox in order to allow the cold air normally found at or near the floor of a room to enter along the bottom of the fireplace enclosure and thereby promote free air convection. This free air convection is also dependent on the spacing and geometry of the heating unit firebox with respect to the walls of the fireplace. Neither Johnston nor Meier disclose an apparatus for insertion into a fireplace enclosure that has the proper shape and spacing from the enclosure to efficiently promote free air convection.

Furthermore, a self-contained enclosure version of the present invention allows the portable heating unit to be used in a home that has no fireplace. In this version of the invention, the portable heating unit mates with a self-contained enclosure that may be placed anywhere within a home that is near a chimney. A triangular-shaped flue of the self-contained enclosure interconnects with an adjoining chimeny to allow the escape of combustion exhaust gases. Due to the thermal insulation of the enclosure, as well as the manner in which the heating unit mates with the enclosure, the outside wall temperature of the self-contained enclosure is low enough to allow placing it in a home without need for special heat resistant masonry. If the flue is placed within a decorative enclosure, air vent holes or a double-walled chimney may be used to exhaust heated air from within the enclosure.

In addition, the heating unit may include a heat radiator that interconnects with the hot water heating system of a home and is able to provide auxiliary heating of this hot water when the home furnace is inoperable.

Further features and other objects and advantages of this invention will become more apparent from the study of the following detailed description with reference to the drawings.

SUMMARY OF THE INVENTION

Briefly, according to one embodiment of the present invention, there is provided a self-contained sealed heating unit comprising an enclosure surrounding a hearth on which fuel is burned. The entire unit is on wheels or casters which allow it to be positioned in the opening of an existing fireplace or alternatively in a masonry or other self-contained enclosure specifically designed for use with such a heating unit. When the heating unit is used with a self-contained enclosure, the flue and ductwork may be placed within a decorative enclosure. To prevent heat buildup within this enclosure, the flue and duct-work may be thermally insulated or provided with air vent holes or interfitted to a double-walled chimney so as to exhaust heated air from the enclsoure.

The portable heating unit further has a lever action damping unit located in its upper rear portion that cooperates with the standard fireplace flue system by means of a combination of a damper flue attachment and an adapter plate which are fitted in the permanent damper frame of the fireplace. The damper flue attachment and the adapter plate are shown in alternate configurations for adapting with any type of flue system in a standard fireplace. The lever action damping unit is constructed so as to allow the escape of a limited amount of exhaust products even when the unit is in a fully closed position, thus preventing smoke buildup within the heating unit even if the lever is placed in this position. In one embodiment, the damper flue attachment and adapter plate are supported by the permanent damper frame whereas in an alternate embodiment they are mounted to the present fireplace flue system by means of a pair of vertically mounted telescoping T-members. The use of the telescoping T-members allows easy installation of the present invention while providing a tight seal by the damper flue attachment and adapter plate that prevents heated air flowing by convection between the heating unit and the fireplace enclosure from escaping up the chimney. Such a seal is very important for the efficient use of such an invention and is not disclosed in any of the prior art inventions showing an adapter plate around a standard damper flue. Either embodiment permits the products of combustion produced in the heating unit to be expelled through the standard flue system of the fireplace.

The self-contained heating unit is further provided with a periphereal screen or wire mesh which surrounds the heating unit and engages the brick or stone work of the fireplace. When properly located, there is space created between the back wall of the heating unit and the firebrick back wall of the fireplace. Thus, the back wall of the heating unit in combination with the back wall of the fireplace enclosure, act as a passageway that promotes air circulation by heating the cold air entering beneath the heating unit. Thus, free air convection is greatly enhanced by this spacing of the heating unit with respect to the fireplace enclosure. This air is further heated as it flows over the upper sidewalls and top wall of the heating unit and finally out of the fireplace enclosure into the surrounding room. Thus, the heated air flows by convection up and over the heating unit, and is discharged out the top portion of the screen mesh into the room, providing a continuous supply of heated air.

Accordingly, a heating unit is disclosed that provides for two air streams, one to provide air for the combustion process and another air stream that is heated by passing around the outer surface of the heating unit and directed back into the room for heating purposes.

Furthermore, a radiator may be mounted to the inside backwall of the heating unit to interconnect with a home's hot water heating system so as to provide alternate heating means for the hot water system when the home furnace is inoperable. This system requires little additional plumbing to a standard hot water heated home and provides its own heat circulation due to convection currents generated inside the mounted radiator within the heating unit.

The heating unit may also be adapted to stand alone for use as a barbecue. Since the air flow to support the combustion process is controllable, grease or fat flare-ups may be prevented.

Further features of this invention will become more apparent with reference to the following drawings.

THE DRAWINGS

FIG. 1 is a front perspective view of the portable heating unit installed in a typical fireplace opening.

FIG. 2 is a cross-sectional side elevation view of the heating unit installed in a fireplace chamber and illustrates the provisions made for the adaptable damper system in addition to showing the area created for heated air flow between the back wall of the heating unit and the back wall of the fireplace.

FIG. 3 is an exploded perspective assembly view of the damper adapter system.

FIG. 4 is a fragmentary plan view of the damper adapter installation.

FIG. 5 is a partial cross-sectional front elevational view of the channel construction of the screen or wire mesh support frame.

Figure 16A:
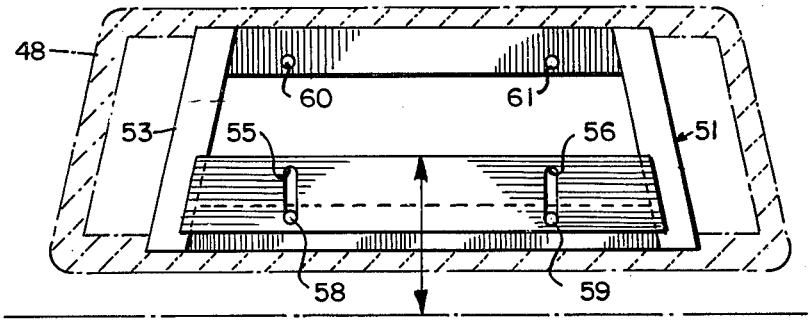
Figure 16B:
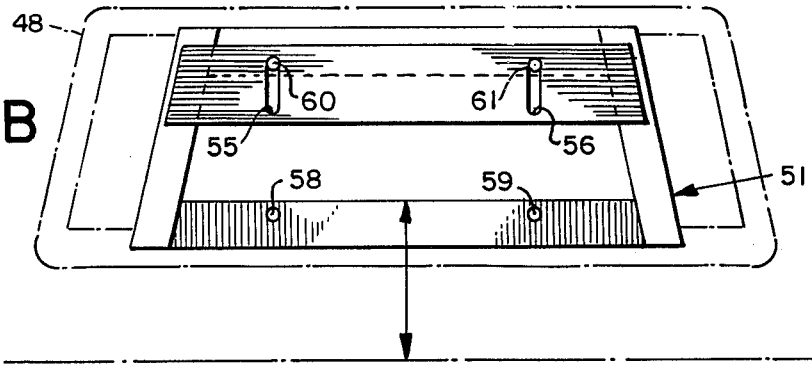

FIG. 16, comprising FIGS. 16A and 16B, is a perspective view of the adapter plate and aperture adapter system of an alternate damper adapter system of the present invention showing the aperture adapter plate in two configurations.

Figure 17:
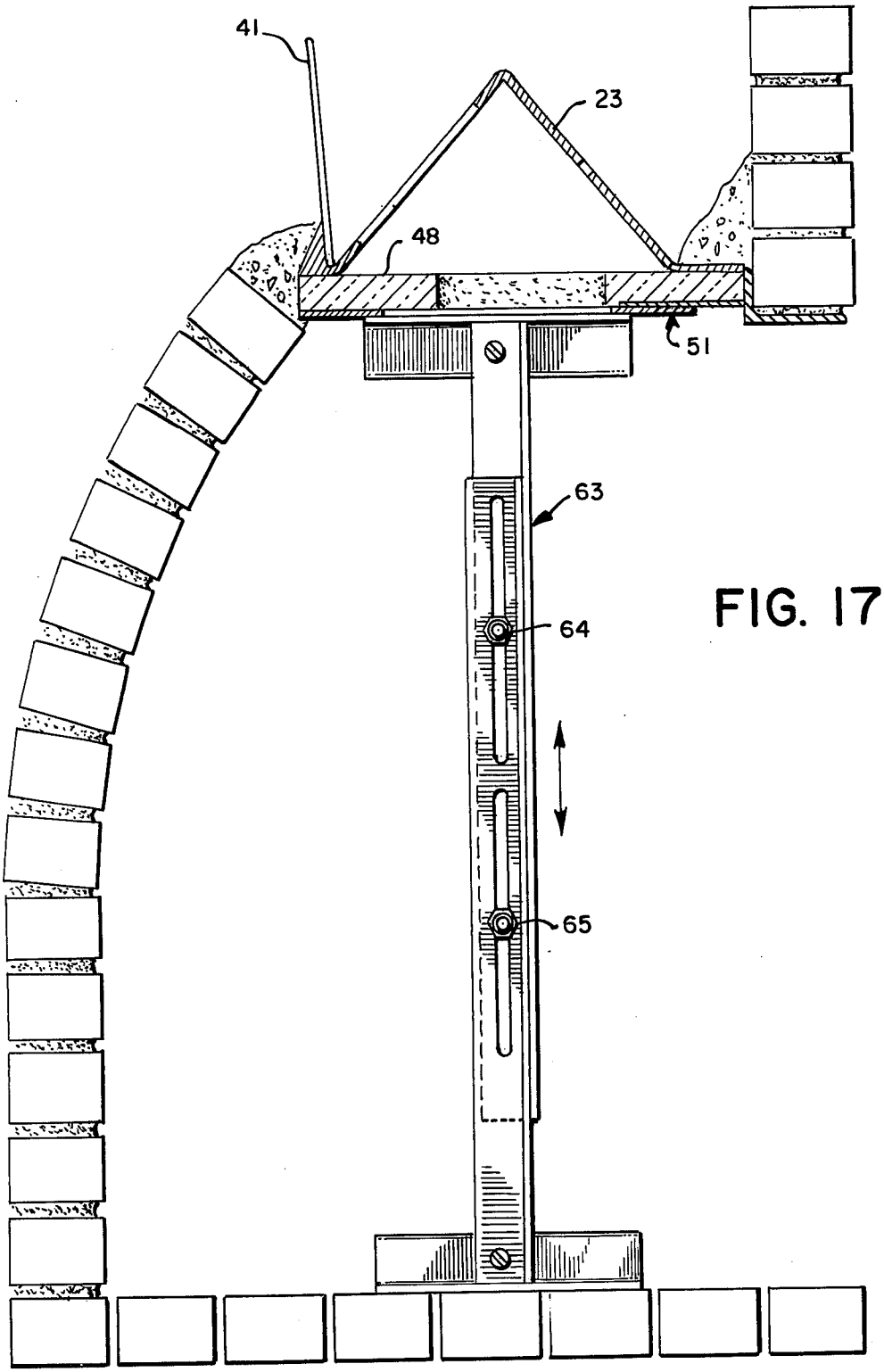

FIG. 17 is a side elevational view of a pair of telescoping T-members of the present invention showing their placement within a standard fireplace enclosure supporting the aperture adapter system and the adapter place of an alternate embodiment of the damper adapter system of the present nvention.

Figure 18:
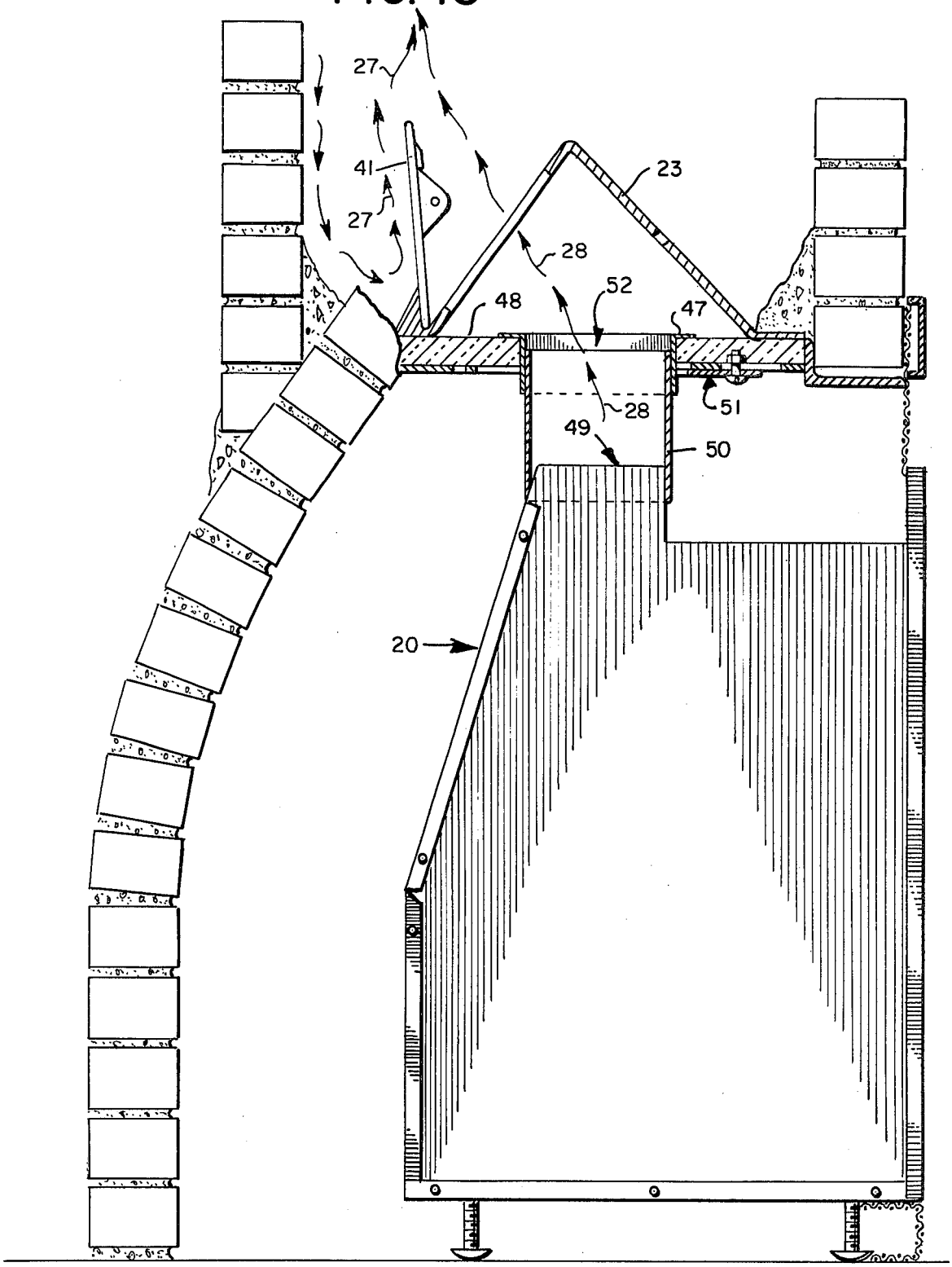

FIG. 18 is a cross-sectional side elevation view of the present invention and the alternate damper adapter system of the present invention as installed in a standard fireplace.

Figure 19:
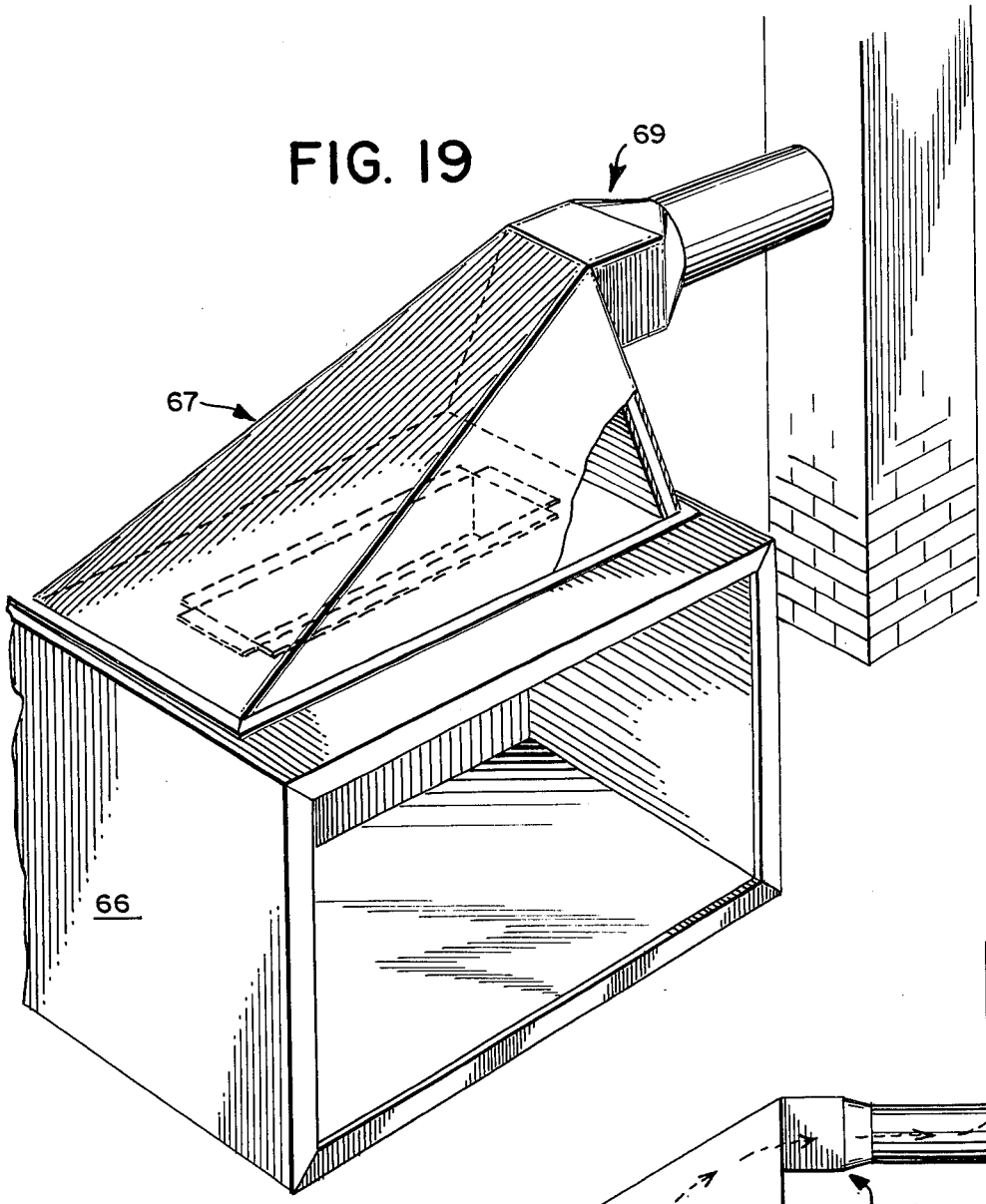

FIG. 19 is a perspective view of an alternate free-standing fireplace enclosure structure to accommodate the portable heating unit of the present invention.

Figure 20:
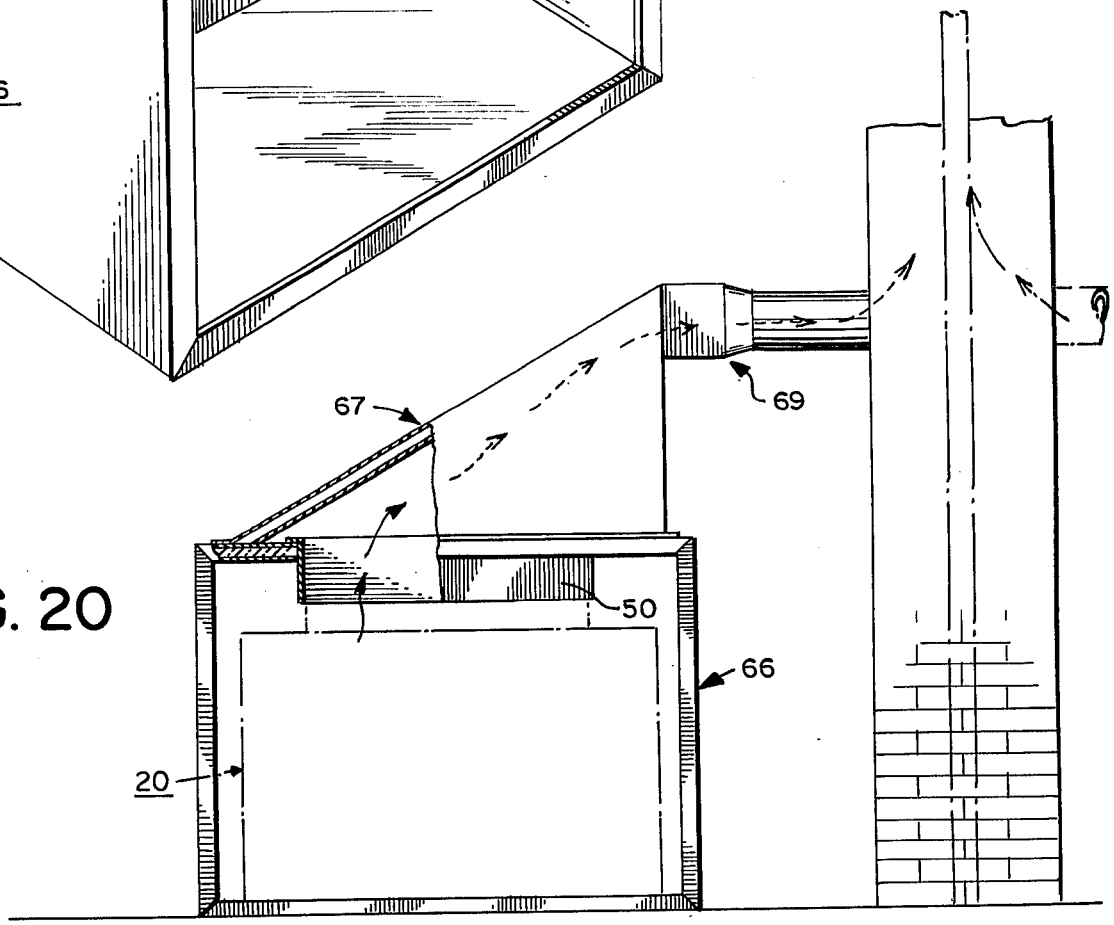

FIG. 20 is a partial cross-sectional front elevation view of the free-standing fireplace enclosure shown in FIG. 19 indicating the direction of flow of combustible matter from the portable heating unit to a standard chimney and showing that two alternate free-standing fireplace enclosure structures may be used in conjunction with one chimney.

Figure 21:
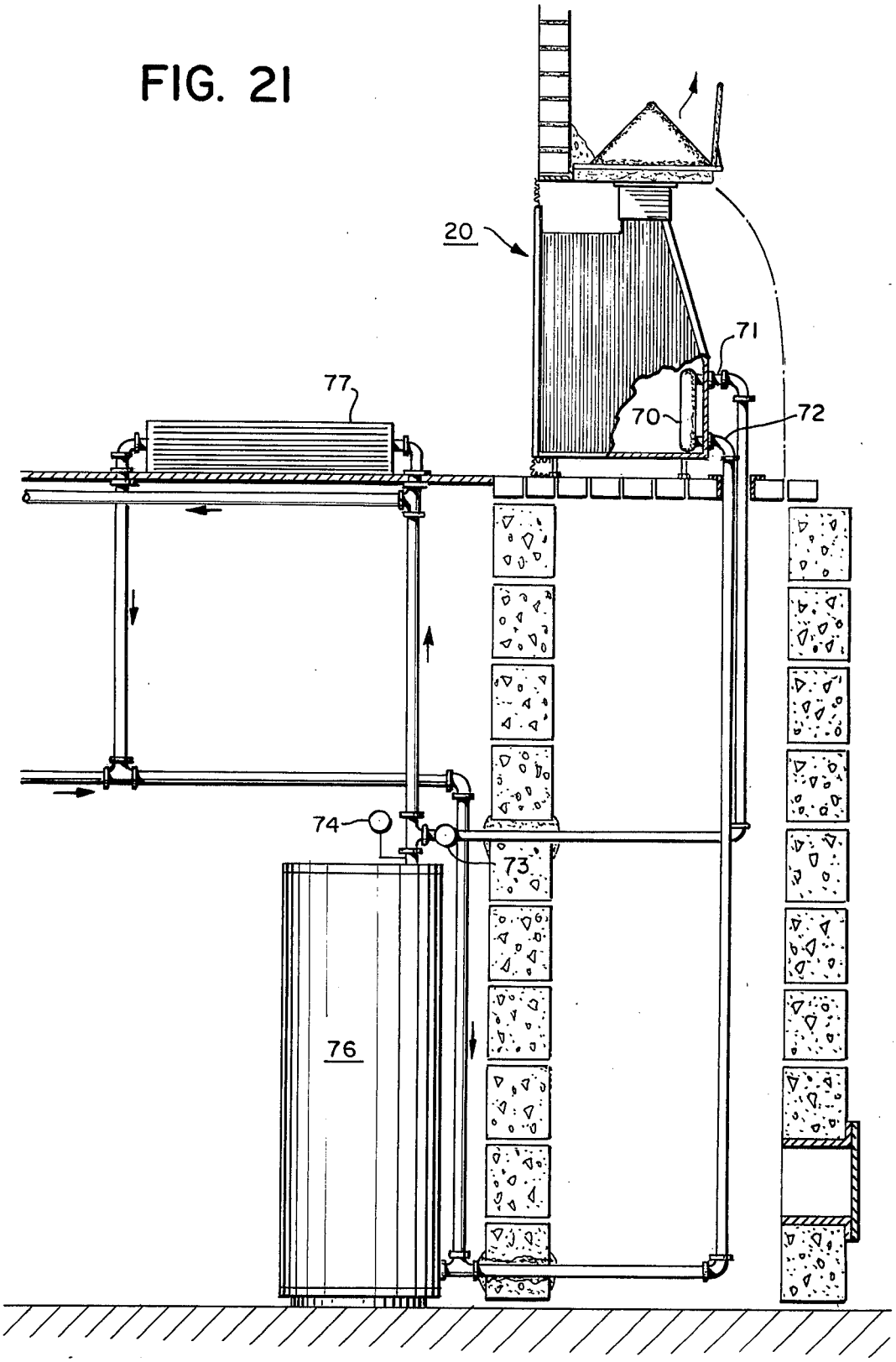

FIG. 21 is a diagrammatic cross-sectional side elevational view of a hot water radiator mounted within the portable heating unit of the present invention and showing its interconnection to a hot water heating system.

Figure 22:
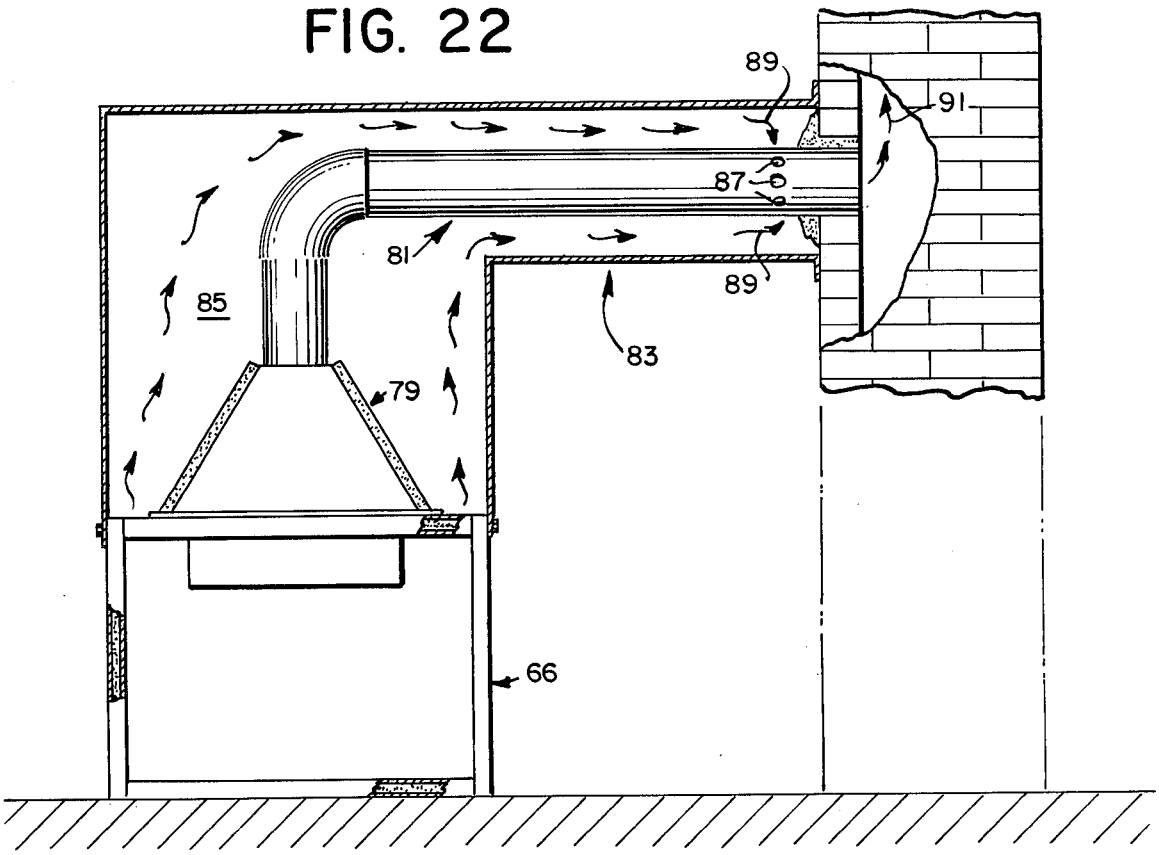

FIG. 22 is a diagrammatic cross-sectional, partially cut away view of a free-standing fireplace enclosure, flue, ductwork, and decorative housing interconnected to a standard chimney showing the exhaust of heated air from within the decorative housing.

Figure 23:
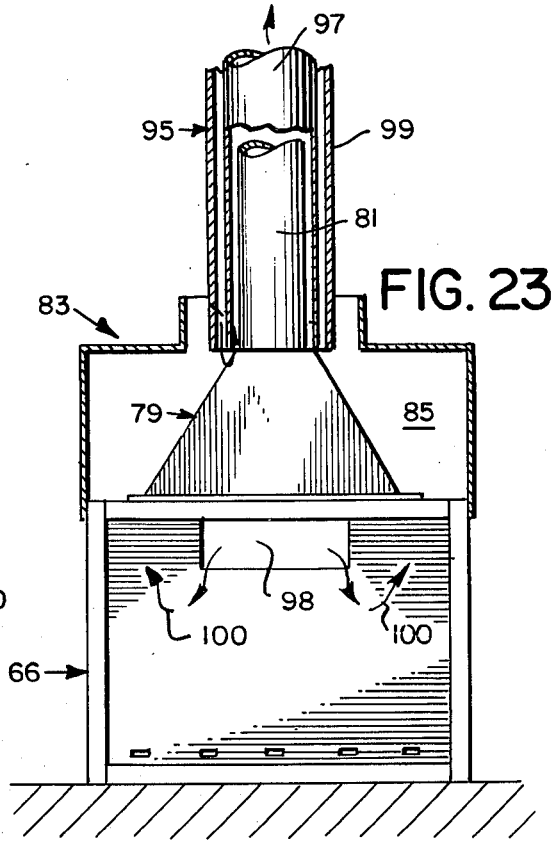

FIG. 23 is a cross-sectional back elevational view of an alternate embodiment of the flue and ductwork of a free-standing version of the present invention showing the use of a double-walled chimney to exhaust heated air from a decorative enclosure.

Figure 24:
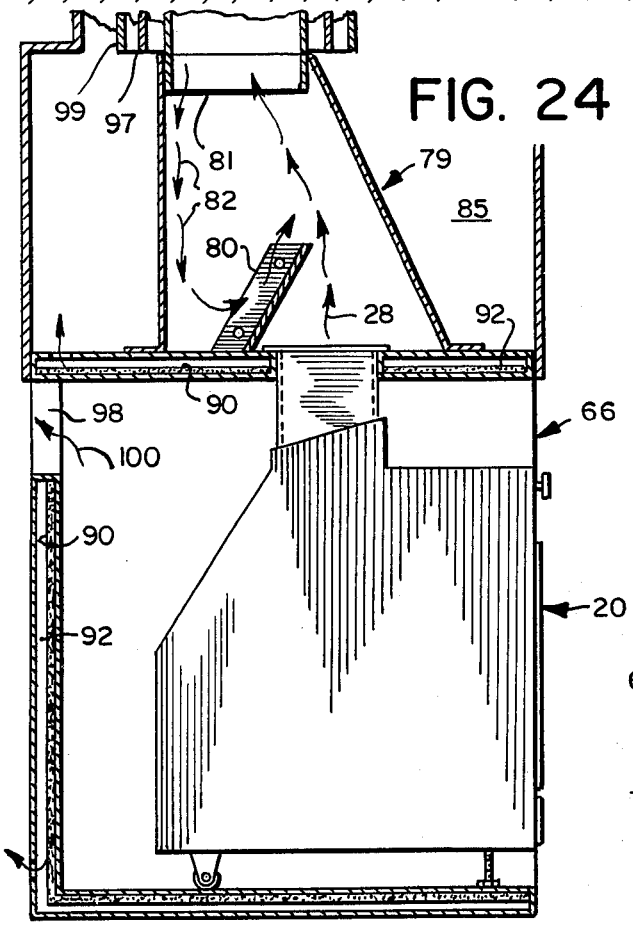

FIG. 24 is a cross-sectional side elevational view of the present invention as shown in FIG. 23.

Figure 25:
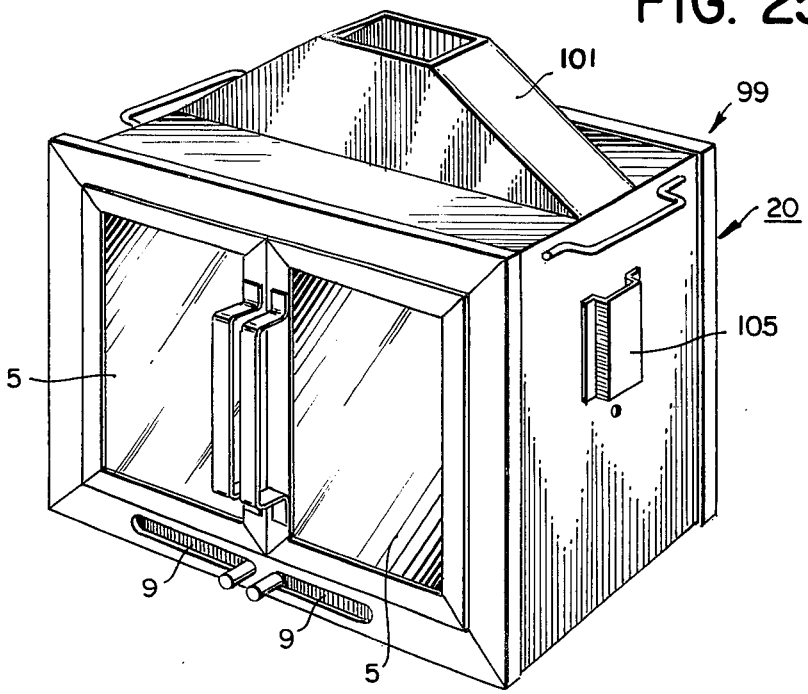

FIG. 25 is a perspective view of an alternate embodiment of the present invention adapted for use as an outdoor barbecue.

Figure 26:
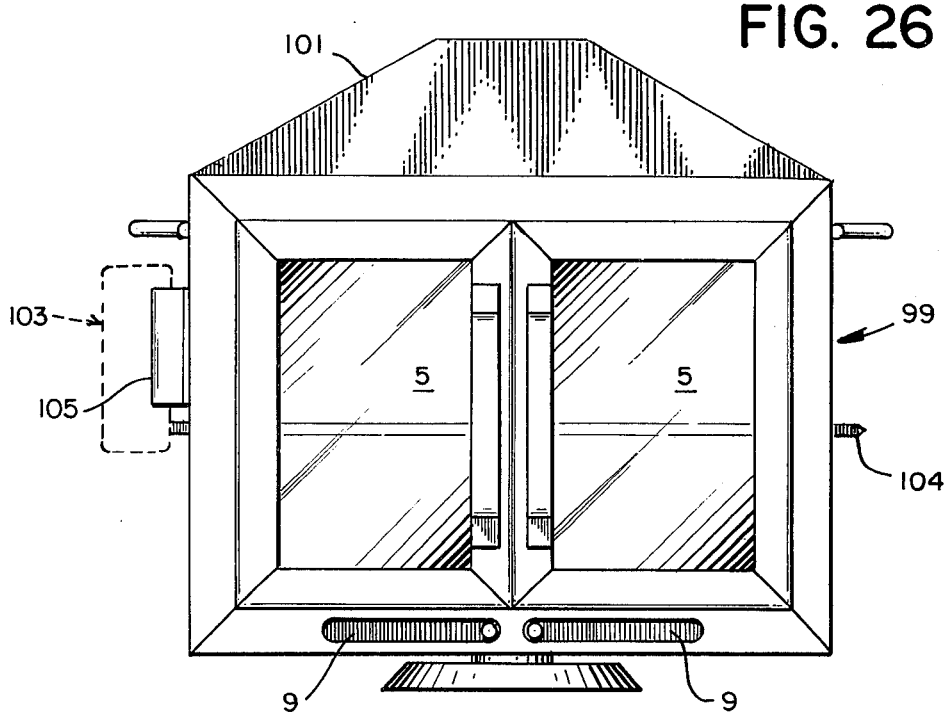

FIG. 26 is a rear elevational view of the alternate embodiment of the present invention as shown in FIG. 25.

Figure 27:
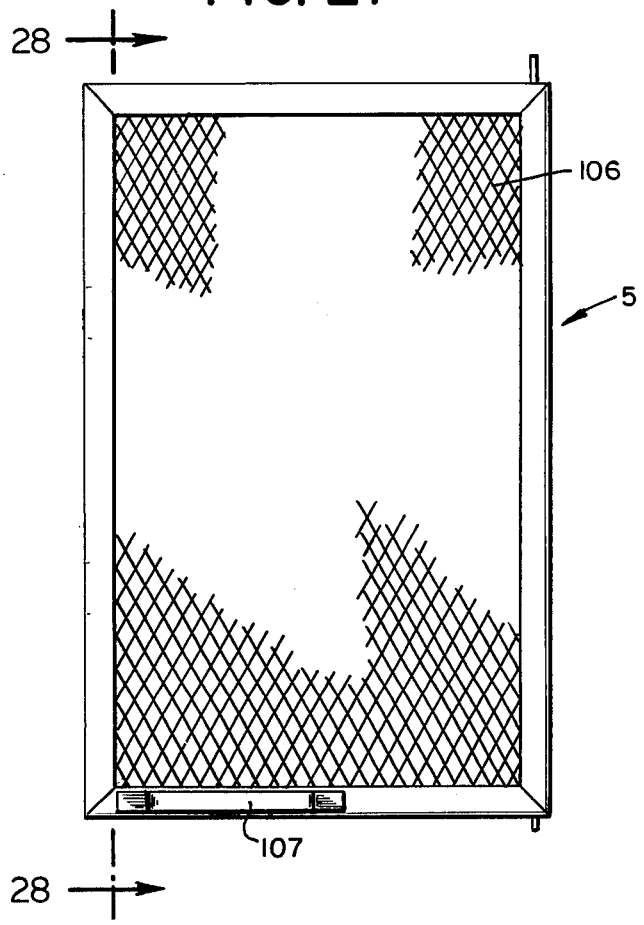

FIG. 27 is a front elevational view of an alternate metal front door used on the portable heating unit.

Figure 28:
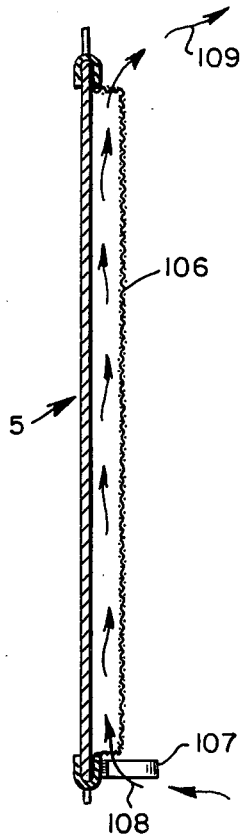

FIG. 28 is a cross-sectional side elevational view of the door shown in FIG. 27.

Thus, as shown in the drawings, the self-contained heating unit 20 which may be located on casters to facilitate installation and removal of the unit from the fireplace opening, has a built in damper system which cooperates with the fireplace damper and flue system by means of an adapter plate and a damper flue attachment.

Further, the front of the heating unit comprises an outer framework which supports a frontal screen 3 through which air is drawn in at the bottom *3a*, heated, and expelled through the top portion. The bottom portion *3a* of the frontal screen is thus important for the promotion of free air convection around the heating unit. It has been found that the prior art inventions such as Meier and Johnston, by not teaching such an air inlet, will not promote a free air convection system comparable to the present invention since cold air is not able to enter and circulate between these prior art devices and the periphery of the fireplace enclosure. In addition, a pair of swinging glass doors 5, through which fuel is added to the interior firebox or hearth area, are supported by a portal fascia which engages the screen mesh. Alternately, as best seen in FIG. 27, the swinging doors may be constructed from metal. Finally, a pair of smaller sliding vent doors 9, located in the bottom portion of the portal fascia, controls the entry of air into the combustion chamber.

In particular and with reference to the foregoing drawings, FIG. 1 shows the potable substantially enclosed heating unit 20 installed in a typical fireplace opening 1. The front of the heating unit 20 is surrounded by an outer framework 2 supporting a frontal screen or wire mesh 3 of expanded metal for example. Screen 3 is attached or juxtaposed to the portal fascia 4 of the unit 20, which supports a pair of swinging glass doors 5. The construction of the supporting framework 2 is shown further in FIG. 5, wherein a right angled plug or corner slug 6 serves as a coupling for holding together two mitred ends of the framework channel force-fitted thereon, thus forming a corner.

A knobbed lever 8 which activates the damper system protrudes frm the frontal screen 3 or the fascia 4, and a pair of sliding vent doors 9 permits the flow of the primary air into the combustion chamber forming the interior or firebox enclosed by the sheet-metal heating unit 20.

FIG. 2 shows the baseplate 10 of the portable heating unit 20 on which a hearth 11 for holding of fuel may be placed. Attached to the base-plate 10 are two sets of casters 12 which allow the heating unit to be installed and removed from the fireplace chamber quickly and easily.

The backwall 15 of the heating unit 20 serves to contain the products of combustion and also forms a passageway 21 between it and the fireplace backwall brickwork 16 wherein air drawn in at the bottom front of the unit through the bottom frontal screen *3a* may be heated as it circulates back, around and up the heated backwall 15. This preheated air is then directed toward the front of the heating unit and out the top frontal screen 3 area to provide a heating source to the room in which the unit is located.

Figure 6:
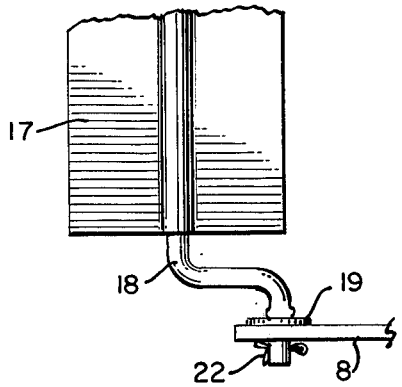
FIG. 6 is a partial plan view of the lever-damper assembly.

The lever arm 8 is attached to a heating unit damper plate 17 by means of a crank 18, and is held in place by a washer 19 and cotterpin assembly 22, best shown in FIG. 6. This assembly permits actuation of the damper plate 17 from the front of the heating unit 20. Further, the damper lever arm 8 is notched so that it may be positioned in several stages, thus controlling the incremental opening of the damper plate 17. The damper plate has a smaller cross-sectional area than the channel adapter flue attachment 25, thereby preventing smoke buildup inside the self-contained heating unit 20 even when the damper plate is in the fully closed position. Thus, a child or an adult cannot inadvertently cause smoke buildup within the heating unit.

As shown in FIG. 2, the adaptive damper system comprises the permanent damper frame 23 with a tongue 23A which protrudes forward above the fireplace, and an adapter plate 24 and channeled adapter flue attachment 25 which engage the damper frame 23 as schematically shown in FIG. 3. This damper assembly mates directly on the upper damper plate-flue system in the heating unit 20 to provide a continuous path for the products of combustion.

The adaptive damper system is easily installed in the standard fireplace opening by firest removing the original fireplace damper plate from the permanent damper frame 23. A flat, apertured damper adapter plate 24 and a flanged damper flue conduit attachment 25 as shown in FIGS. 3, 4 and 5 are then positioned via the tongue 23A on the permanent damper frame 23 and the mating channel *23b* formed in the damper flue attachment 25 as shown best in FIGS. 3–5. When in position, the damper flue attachment 25 has its peripheral flange *25a* resting on the adapter plate 24, and its lower end engages the top framework of the damper assembly of the heating unit, thus providing a continuous path for the products of combustion from the hearth up and through the damper and flue system and out the chimney.

As best seen in FIGS. 2 and 3, a flat upper portion *25b* of the damper flue conduit attachment 25 acts as a smoke deflector to promote the escape of combustion products up the chimney. As seen in FIG. 2, by arrows 27, cold air flows down the chimney and is deflected upwards, away from the aperture in conduit attachment 25 by the smoke deflector portion *25b* of this conduit attachment. This upwardly deflected air causes combustion products shown by arrows 28 to escape from the heating unit up the chimney. If conduit attachment 25 did not have the smoke deflector portion *25b*, the cold air would circulate directly over the aperture in this attachment preventing the escape of combustion products from the heating unit. The opening of doors 5 would then result in the escape of smoke into the living quarters. This is precisely the type of problem not overcome by either the Meier of Johnston prior art devices.

An alternative version of the adaptive damper system is best seen in FIGS. 13, 14, 15, 16, 17 and 18. As seen in FIGS. 13, 14, 15 and 18, the damper plate 41 of a standard fireplace is permanently positioned in a fully open configuration by removal of cotter pin 42 holding damper lever 43 to the damper plate. Removal of damper lever 43 also requires the removal of damper screw 46.

Figure 13:
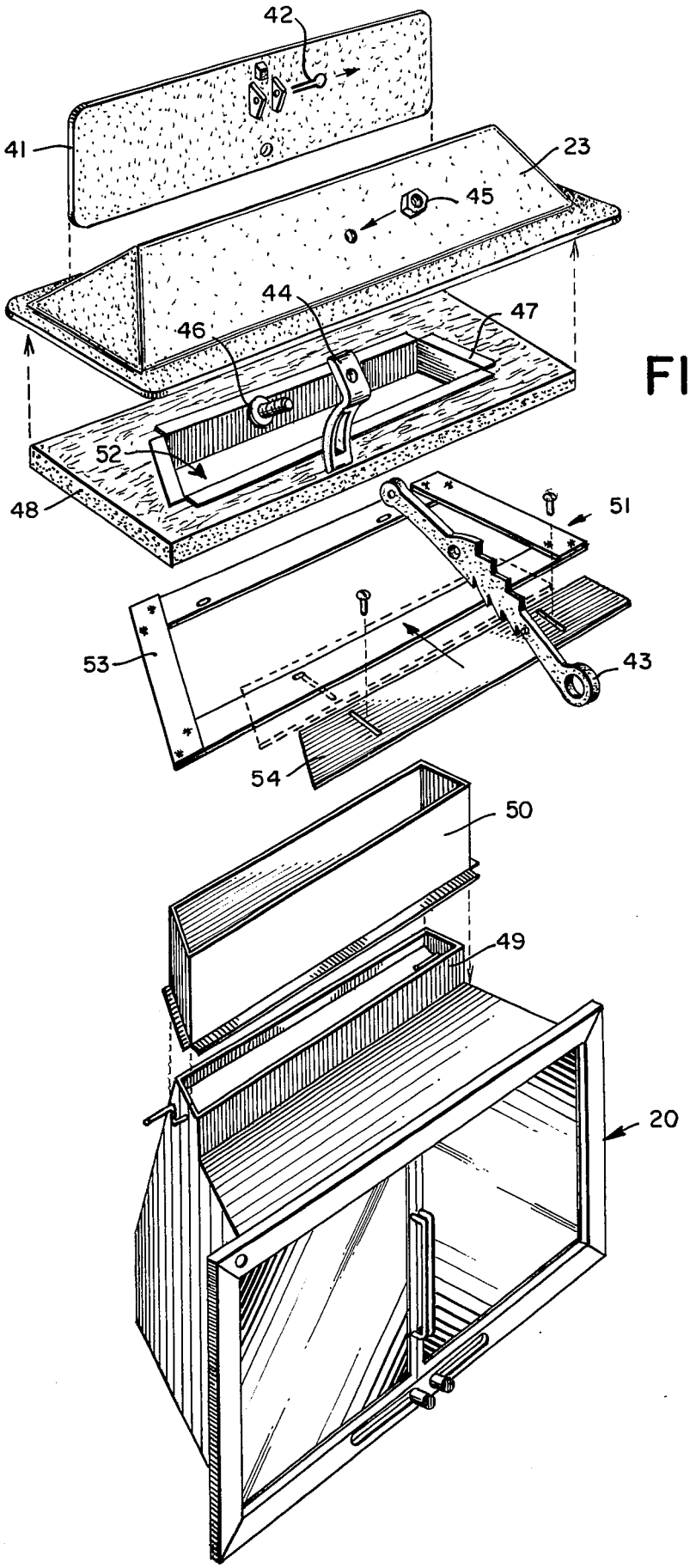
FIG. 13 is an exploded perspective assembly view of an alternate damper adapter system of the present invention.
Figure 14:
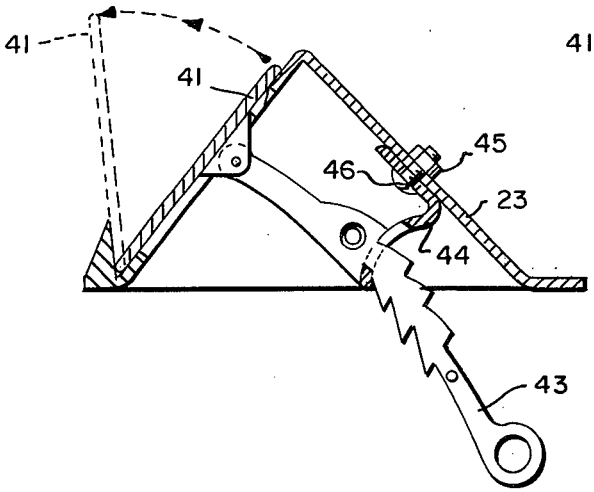
FIG. 14 is a cross-sectional side view of a damper assembly found in a standard fireplace showing the damper in both the closed and fully opened positions.
Figure 15:
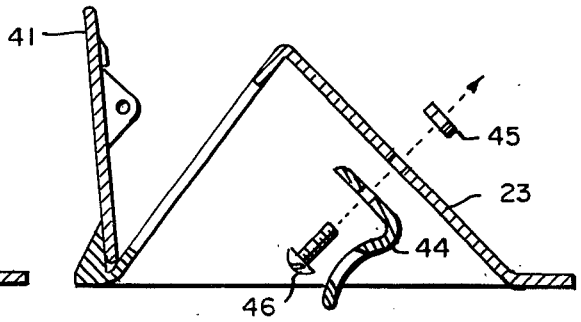
FIG. 15 is a similar cross-sectional view as shown in FIG. 14 showing the standard damper plate in the open position and showing the disassembly of the damper lever adjuster.

A flat, apertured adapter plate 48 fits below the damper frame 23 thus providing an aperture 52 defined by metal insert 47 for the release of combustible material from the self-contained heating unit 20. However, for the proper alignment of the heating unit within a typical fireplace opening, it is necessary that the aperture defined in adapter 48 be larger than the upper aperture defined in the heating unit 20 via upper channel portion 49. It is therefore necessary that damper flue conduit 50 snugly mate with the aperture defined in adapter plate 48 in order to prevent the escape of combustion exhaust gases and fly ash material within the fireplace enclosure. As best seen in FIGS. 13, 16A and 16B, this requirement is accomplished through the use of an aperture adapter system 51 comprising an aperture adapter frame 53 and an aperture adapter plate 54. As seen in FIGS. 16A and 16B, the adapter plate 54 may be positioned on the adapter frame 53 in a plurality of configurations by variously aligning adapter plate slots 55 and 56 with either holes 58 and 59, or holes 60 and 61. The resultant opening defined by the aperture adapter plate 54 and the aperture adapter frame 53 allows damper flue conduit 50 to snugly interfit through the generated aperture so as to provide a continuous path for the products of combustion to escape from the heating unit to the chimney. The resultant arrangement of this flue system may best be seen in FIG. 18.

As best seen in FIG. 17, the adapter plate 48 and the aperture adapter system 51 are held in place against the permanent damper frame 23 by means of a pair of telescoping T-members 63 that extend from the bottom wall of the existing fireplace up to the aperture adapter system. The particular height that is needed to maintain the aperture adapter system and adapter plate against the existing damper frame is obtained by spreading apart each pair of telescoping T-members and locking the respective members together by means of machine screw and nut assemblies 64 and 65. It should be noted that these two pairs of telescoping T-members are positioned near the sidewalls of the existing fireplace enclosure so as to allow the heating unit to be easily installed and removed without disturbing the flue system of the present invention. Indeed, installation of the heating unit of the present invention using this alternate flue system requires no more than positioning the damper flue conduit 50 within the defined aperture opening in the aperture adapter system, insertion of the heating unit 20 within the existing fireplace opening and release of the conduit so as to engage with the upper channel portion of the heating unit 20. Removal of the heating unit merely requires the reverse operation. of the above steps.

As also seen in FIGS. 17 and 18, by arrows 27, cold air flowing down the chimney is deflected upward by opened damper plate 41, causing the products of combustion shown by arrows 28 to flow up the chimney.

Figure 7:
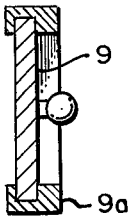
FIG. 7 is a cross-sectional side elevation view of the small sliding door vent assembly in the front of the heating unit which controls the volume of air supplied to the combustion chamber.
Figure 10:
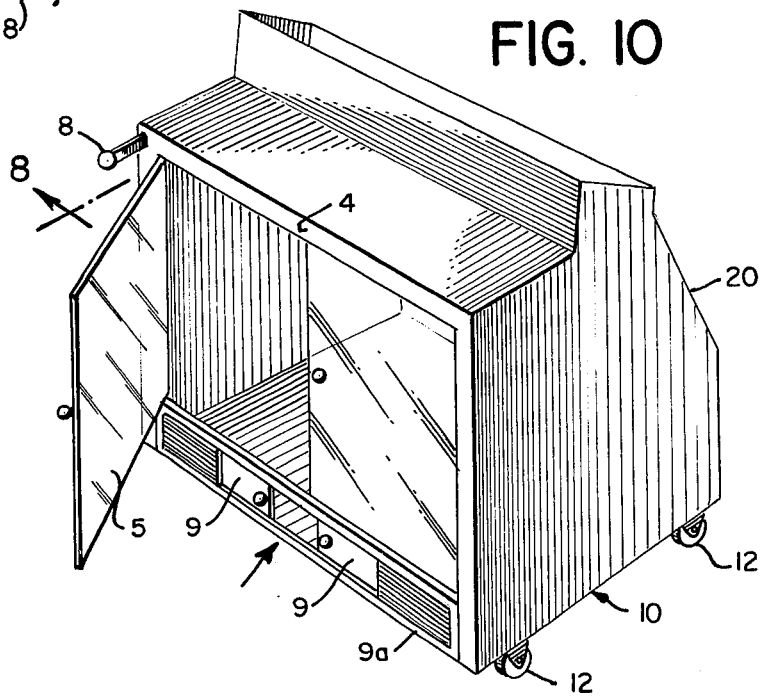
FIG. 10 is a perspective view of the portable self-contained heating unit.
Figure 8:
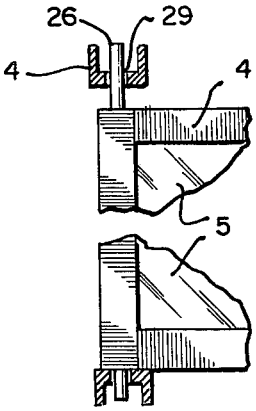
FIGS. 8 and 9 are cross-sectional side elevational views of the large swinging glass door frame hinge assembly, respectively showing a door installed and being removed.
Figure 9:
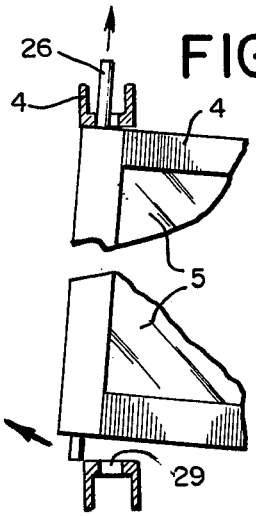

Referring now to FIG. 7, the sliding vent doors 9 of heating unit 20 are supported by a lower channel framework 9*a*, forming an underlying portion of the fascia 4. As shown in FIGS. 8–10, the front glass doors 5 are surrounded by the metal support frame or fascia 4. The door hinge assembly consists of two axle pins 26 respectively welded on the top and bottom of the door frame, which engage two holes 29 in the support frame 4. The top pin is slightly longer than the bottom pin, which allows the door to be inserted and removed from the door support framework 4 by first inserting the longer top pin as far as it will go and then lining up the shorter bottom pin and allowing it to descend and rest in the hole 29 provided in the lower portion of supporting fascia framework 4.

Figure 11:
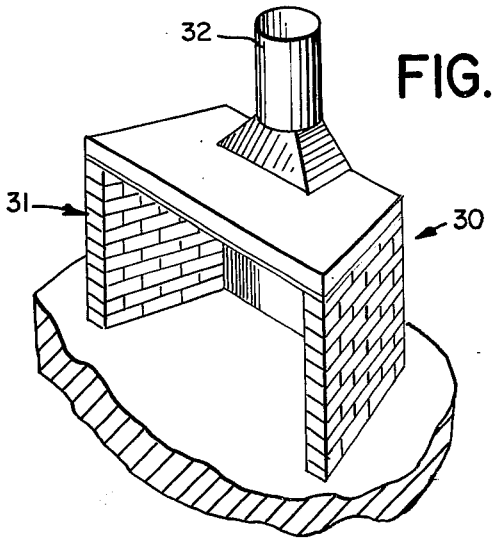
FIG. 11 shows a free-standing fireplace enclosure structure to accommodate the portable heating unit.

FIG. 11 shows a free-standing fireplace chamber that is specifically designed for use with my heating unit. The chamber 30 is composed of standard brickwork 31 forming the combustion chamber and an exhaust flue assembly 32. The advantage of such a free-standing fireplace unit is that it may be located anywhere in the room, even in the middle of a room, to provide a more centralized point for the heat source.

An alternate version of a free-standing fireplace chamber is best seen in FIGS. 19 and 20. As seen in FIG. 20, this free-standing fireplace chamber comprises a self-contained enclosure 66 that is preferably a double walled metal structure incorporating a thermally insulating material 68, such as asbestos or vermiculite, between the two walls. This double walled arrangement is schematically shown in FIG. 20. The self-contained enclosure, due to its thermal insulating properties and due to the arrangement of the heating unit within the enclosure, allows the enclosure to be placed in existing dwellings without the need for masonry brick protection underneath or surrounding the enclosure.

Above the self-contained enclosure a triangular-shaped flue 67 is mounted incorporating ductwork generally shown as 69 for interconnecting the flue to an existing chimney. An aperture is defined in the upper wall of the self-contained enclosure for permitting the escape of combustible material through a flanged damper flue conduit 50 of the heating unit 20 into the flue system, defined by flue 67 and ductwork 69.

As best seen in FIG. 20, this alternate version of a free-standing fireplace chamber may be mounted in a room with a chimney to the right-hand side of the fireplace chamber or the left-hand side of the fireplace chamber due to mounting of the triangular flue housing to the self-contained enclosure in either a right-hand or left-hand configuration. It is therefore possible for more than one free-standing fireplace chamber of the present invention to be used on the same level of a dwelling with the same chimney. This greatly minimizes the cost of construction of fireplaces in multiple dwelling units such as apartments and condominiums.

As best seen in FIG. 22, an alternate flue 79 and ductwork 81 may be mounted above the self-contained enclosure 66. Both the flue and ductwork may be installed within a decorative enclosure 83. When so installed, heated air within decorative enclosure volume 85 must be exhausted therefrom to prevent a fire hazard. As shown in FIG. 22, this may be accomplished by vent holes 87 which due to Bernoulli's Principle cause the heated air within the enclosure volume to exit therefrom, as shown by arrows 89, when combustible matter, as shown by arrows 91, exhausts through ductwork 81 up chimney 93.

As shown in FIGS. 23 and 24, the flue 79 may directly communicate with a double-walled chimney 95 comprising inner chimney tube 97 and outer chimney tube 99. The heated air generated within decorative enclosure volume 85 rises up between ductwork 81 and inner chimney tube 97. Cold air from the outside flows between the inner and outer chimney tubes to additionally cool volume 85. As shown in FIG. 24, it should also be noted that within flue 79, a smoke deflector 80 is permanently installed helping the generation of a draft, as shown by arrows 82, within the ductworth 81 and the inner chimney tube 97 for the exhaust of smoke from the portable heating unit. Thus the cold air flowing down the chimney is deflected upward by the smoke shelf, causing smoke and other products of combustion shown by arrows 28 to escape up the chimney. The cold air flowing down the chimney is therefore not able to prevent the escape of combustion products from the heating unit by circulating directly over the damper conduit.

The free-standing and self-contained enclosure 66 has a double wall construction on all sides but the front portion for proper insulation of the enclosure without the need for firebrick or other additional insulating materials. Within the double walls insulation 90 of preferably 1-inch thickness is placed along the inner wall to further cool outer wall temperatures when the heating unit is operating. An air space 92 between this insulation and the outer wall of the enclosure provides additional insulation.

As shown in FIG. 24, the self-contained enclosure 66 may incorporate a rear exit portal 98 for the flow of warm air through the rear of the enclosure. In this manner, as shown by arrow 100, a room sharing a wall with the room in which the present invention is located, may be heated by the self-contained portable heating unit. The rear exit portal is also useful in more evenly heating an entire room when the self-contained enclosure is installed away from the walls of the room.

Figure 12:
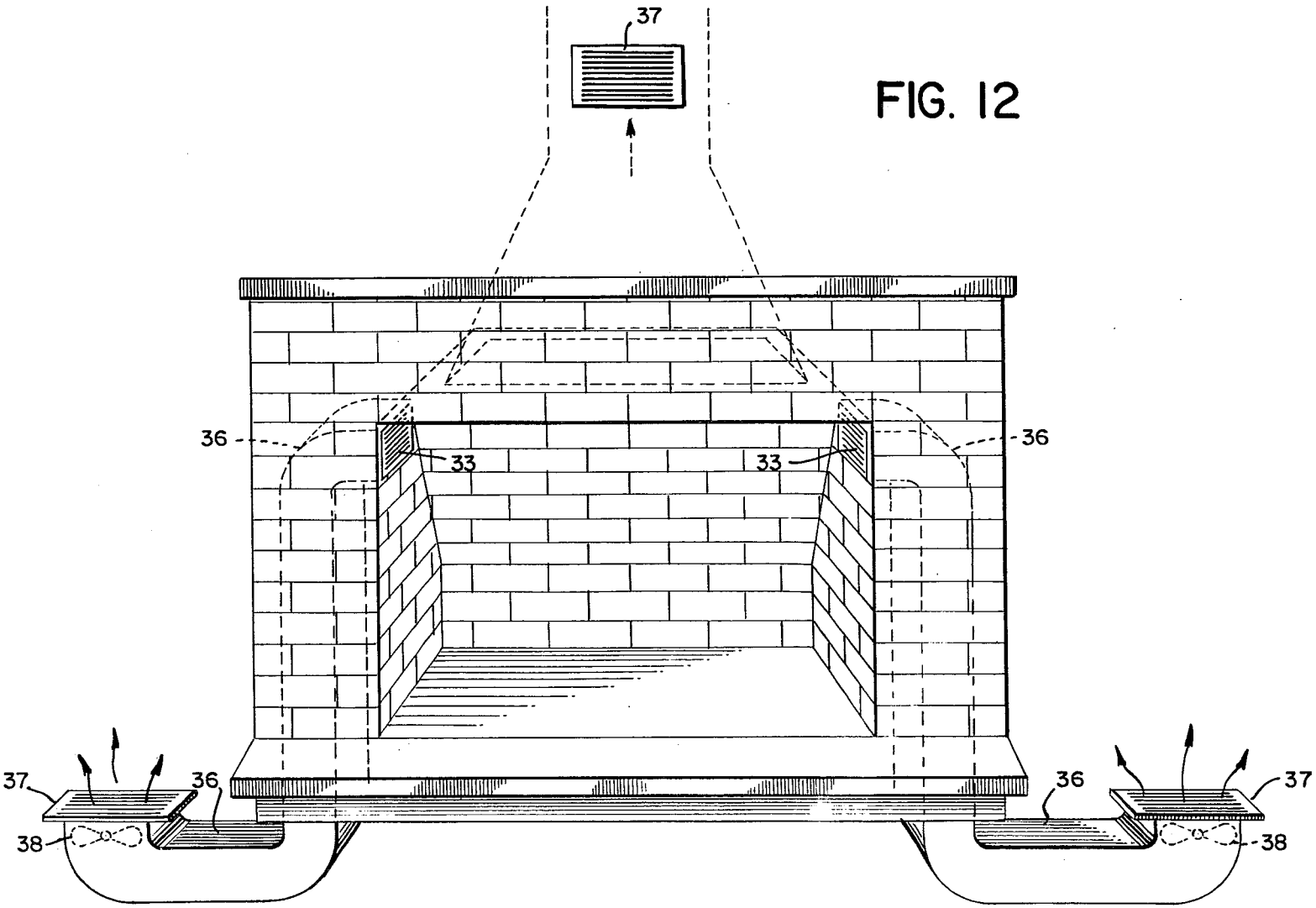
FIG. 12 is a front perspective view of a new raised fireplace construction incorporating provisions for heated air circulation.

FIG. 12 depicts another fireplace chamber specifically designed for use with my heating unit wherein a provision is made in the brickwork of the back wall of the fireplace so that one or more ducts 33 may be installed in the wall extending through the masonry firewall into the space created between the fireplace wall and the back of the heating unit. Further, a continuous duct work 36 is provided between the fireplace wall opening and a vent 38 or series of vents located in the wall above the heating unit or in the adjacent floor of the room or wherever the heated air is to be delivered. Thus a heated air stream is directed away from the heating unit by duct work to any point in the room where a hot air stream is desired. A small fan 38 may be provided to help in circulating the warm air stream.

Furthermore, as best seen in FIG. 21, a heat receiving radiator 70 may be mounted within the portable heating unit 20 and connected via high temperature outflow piping 71 and low temperature return piping 72 to the respective high temperature outlet and the low temperature return of a standard hot water furnace system. Valve 73 may be installed in the high temperature piping 71 and closed wherever desired, for example so as to prevent hot water generated by furnace-boiler 76 from entering radiation 70 when the furnace-boiler 76 is operating. Similarly, a valve 74 may be inserted in the high temperature outlet of boiler 76 and closed to bypass furnace-boiler 76 when the radiator 70 is generating hot water for the house radiators, such as radiator 77, during times when the furnace-boiler 76 is inoperable. This system thus provides an alternate means for heating a home, or a portion thereof, when the house hot water furnace-boiler is inoperable, such as during times of power outages.

Radiator 70 is constructed in such a manner that the heated water emanating from piping 71 is at a substantially higher temperature than the returning water coming in via piping 72. Due to this temperature gradient of the water within the radiator, convection currents are generated thereby providing flow of the hot water in the radiator outward through piping 71 to the house radiators. Therefore, this embodiment of the present invention is very effective during times of home furnace outrages by providing not only warm air to the surrounding room within which the heating unit is placed, but also by providing hot water heating to other rooms within the home.

The installation and use of the heating unit may be easily and safely performed. The heating unit is easily rolled into the fireplace opening by means of the four casters 12 located on the base plate 10. Thus the unit may quickly and easily be installed in the fireplace opening when the additional heating is desired and can as easily be removed and stored when the additional heat is not needed.

The doors 5 for adding fuel to the hearth are constructred of tempered glass. The pin hinge assembly shown in FIGS. 8 and 9 allows for easy removal and cleaning of the glass doors. Controlled damping which is provided for by the notched arrangement on the damper arm allows efficient burning of the wood to the extent that 75% less wood is burned than with a conventional fireplace unit. The small vent doors 9 located in the front of the heating unit 20, which allow primary air to enter the combustion chamber, allow only a small volume of air from the room to feed the fire, and thus very little air escapes up the chimney. In addition, the glass doors 5 prevent heat loss from the room.

As best seen in FIGS. 27 and 28, the doors 5 may be alternatively constructed of metal. In this alternate embodiment the doors may incorporate a flat metallic grillwork 106 spaced from the remainder of the doors guiding air convection, flow as shown by arrows 108 and 109 through this space for additional heating. This grillwork may be constructed from "expanded metal." These metal doors also incorporate the pin hinge assembly shown in FIGS. 8 and 9 for easy removal and consequent interchangeability with the glass doors.

Furthermore, the grillwork on the metal doors, prevent human contact with the plate portion of these doors. In addition the grillwork yields an attractive uniform appearance to the entire heating unit.

Furthermore, a handle 107 is mounted along the lower edge of the door. The handle placement allows cool air as shown by arrow 108 to keep the handle at a temperature sufficiently low for safe human contact.

While the unit can be installed in any standard fireplace opening as shown in FIG. 1, a free-standing fireplace as shown in FIGS. 11, 19, 20, 22, 23 and 24 may be constructed specifically for use with this heating unit. The advantage here is that the free-standing unit can be located in any part of a room, wherever the owner wishes. In addition, new fireplace construction may have the provision for additional ductwork as shown in FIG. 12 whereby the preheated air may be circulated via the ductwork to any part of the room and thus provide a more uniform heat distribution. It should be noted that other fuels, such as coal and charcoal will work well in my heating unit as well as firewood.

Additionally, it should be noted that, as best seen in FIGS. 25 and 26, the advantageous properties of glass doors 5, vent doors 9 in conjunction with portable heating unit 20 may be utilized to convert an alternate embodiment of heating unit 20 into an outdoor barbecue 99. Glass doors 5 are located at the front and rear of the barbecue to provide access to food being cooked therein, while vent doors 9 prevent grease or fat flare-ups within the barbecue by restricting the flow of air therein. Flue 101 allows smoke to escape from within the heating chamber of the barbecue. A rotisserie 103 incorporating a skewer 104 may be removably mounted to channel 105 for cooking large items that need constant turning. The skewer passes through the sidewalls of the barbecue into its interior.

While the present invention has been described with regard to certain embodiments and examples, it should be understood that it may be applied to other embodiments without departing from the spirit and scope of this invention. Having thus described the invention in detail and with sufficient particularity to enable those skilled in the art to practice what is desired to have protected by letters patent is set forth in the following claims.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. A portable heating device for use in a standard fireplace opening in conjunction with an aperture permanent damper frame of said standard fireplace, the original fireplace damper plate opened to its furthest upstanding position with the remaining portion of the original fireplace damper assembly disconnected from said original fireplace damper plate, said heating device comprising:

A. housing means, a portion of which forms a heating chamber having an apertured region in the upper portion of said heating chamber, said housing means incorporating means for positioning the housing within the standard fireplace opening inwardly spaced from the masonry wall thereof, said housing further incorporating an openable front portion communicating with the heating chamber for placement of fuel therein;

B. a closeable damper assembly movably mounted in said upper apertured portion of the heating chamber for connecting the heating chamber to the fireplace flue, said damper assembly incorporating, 1. an adapter plate dimensioned to cover and block a pre-existing damper opening in said permanent damper frame having a central aperture formed therein;
2. an aperture adapter assembly dimensioned to cover and block a portion of the central aperture of the adapter plate, comprising:
   a. an aperture adapter frame dimensioned to contact a portion of the adapter plate, having an aperture substantially equal to and aligned with the central aperture of the adapter plate; and
   b. an aperture adapter plate positionably mountable to the aperture adapter frame generating a second central aperture;
3. a damper flue conduit dimensioned to extend through said second central aperture and having:
   a. lower entrance portal juxtaposed to the apertured region in the upper portion of the heating chamber and
   b. an upper exit portal opening into the fireplace flue;
4. a damper plate movably mounted to said housing means at the upper portion of said housing means; and
5. means for manually positioning said damper plate; and C. means for admitting air into the heating chamber; whereby an air convection space is created between the outer portion of the enclosed heating chamber and the masonry fireplace wall so that air entering the convection space is circulated back past the housing and outside the fireplace for space heating purposes.

2. The portable heating device defined in claim 1, wherein the aperture adapter assembly and the adapter plate are positioned and held beneath the damper frame by telescoping support means extending from the masonry floor of a standard fireplace to the lower surface of the aperture adapter assembly, and positioned near the two sidewalls of the standard fireplaces so as to secure the aperture adapter assembly and plate to the existing damper frame while allowing the self-contained heating device to be readily installed and removed from the standard fireplace.

3. The portable heating device defined in claim 2, wherein said telescoping support means comprises a pair of telescoping slotted T-members.

4. The portable heating device defined in claim 1 wherein the damper plate is of a smaller cross-sectional area than the damper flue conduit, thereby preventing smoke buildup within the portable heating device even when the damper plate is in the fully closed position.

5. A portable heating device as defined in claim 1, wherein the openable front portion of the housing means incorporates pivotal glass doors which may be opened to supply fuel to the heating chamber and closed to prevent escape of soot, ashes and smoke.

6. A portable heating device as defined in claim 5, wherein the glass doors are removably pivotally supported by the housing means.

7. A portable heating device as defined in claim 6, wherein each glass door is pivotally secured to the housing by a coaxial pair of pivotal pins.

8. A portable heating device as defined in claim 1, wherein the openable front portion of the housing means incorporates pivotally mounted metal doors which may be opened to supply fuel to the heating chamber and closed to prevent the escape of soot, ashes and smoke, said doors incorporating a substantially flat grillwork spaced therefrom for providing further air convection by the heating device.

9. A portable heating device as defined in claim 1, wherein the housing means inorporates an outer framework spaced from and substantially surrounding said heating chamber, a frontal screen interconnected with the inner periphery of said outer framework, and a portal facia interconnected at its outer periphery with the frontal screen and at its inner periphery with the heating chamber.

10. A portable heating device as defined in claim 1 wherein the aperture adapter plate of the adapter assembly has a pair of parallel slots, and wherein said aperture adapter assembly incorporates a pair of bolts passing through said slots into said aperture adapter frame so as to allow sliding linear positioning of the aperture adapter plate with respect to the adapter frame.

* * * * *

UNITED STATES PATENT AND TRADEMARK OFFICE

CERTIFICATE OF CORRECTION

PATENT NO. : 4,026,264

DATED : May 31, 1977

INVENTOR(S) : Joseph Henriques

It is certified that error appears in the above-identified patent and that said Letters Patent are hereby corrected as shown below:

Col. 2, line 17, cancel "chimeny" and substitute therefor --chimney--.

Col. 2, line 51, cancel "enclsoure" and substitute therefor --enclosure--.

Col. 3, line 19, insert --a-- before "space".

Col. 4, line 40, cancel "place" and substitute therefor --plate-.

Col. 4, line 41, cancel "nvention" and substitute therefor --invention--.

Col. 5, line 43, "potable" should be --portable--.

Col. 5, line 56, cancel "frm" and substitute therefor --from--.

Col. 6, line 34, cancel "firest" and substitute therefor --first--.

Col. 7, line 6, before "screw 46", insert --lever positioner 44 via removal of nut 45 and machine--.

Col. 7, line 58, omit "." after "operation".

Col. 9, line 7, cancel "ductworth" and substitute therefor --ductwork--.

Col. 9, line 59, cancel "wherever" and substitute therefor --whenever--.

Col. 9, line 61, cancel "radiation" and substitute therefor --radiator--.

Col. 10, line 12, cancel "outrages" and substitute therefor --outages--.

UNITED STATES PATENT AND TRADEMARK OFFICE

CERTIFICATE OF CORRECTION

PATENT NO. : 4,026,264

DATED : May 31, 1977

INVENTOR(S) : Joseph Henriques

It is certified that error appears in the above-identified patent and that said Letters Patent are hereby corrected as shown below:

Col. 10, line 25, cancel "constructred" and substitute therefor --constructed--.

Col. 11, line 7, insert --easy-- before "access".

Col. 12, line 31, cancel "fireplaces" and substitute therefor --fireplace--.

Col. 12, line 54, cancel "pivotal" and substitute therefor --pivot--.

Col. 12, line 68, cancel "facia" and substitute therefor --fascia--.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademark*